United States Patent [19]

Davenport et al.

[11] 4,294,042

[45] Oct. 13, 1981

[54] APPARATUS AND METHOD FOR GRINDING A HELICAL SURFACE ON A FLAT BLADE

[75] Inventors: Robert W. Davenport, Golden; Eugene L. Moore, Lakewood; Ronald L. Goodman, Woodland Park, all of Colo.

[73] Assignee: Johns-Manville Corporation, Denver, Colo.

[21] Appl. No.: 72,740

[22] Filed: Sep. 5, 1979

[51] Int. Cl.[3] ..... B24B 3/40; B24B 3/42

[52] U.S. Cl. ..... 51/54; 51/34 A; 51/96; 51/100 R; 51/288

[58] Field of Search ..... 51/34 A, 36, 46, 48 HE, 51/96, 100 R, 288, 54

[56] References Cited

U.S. PATENT DOCUMENTS 2,819,564 1/1958 Johnson ..... 51/288 X 3,638,363 2/1972 Witt ..... 51/48 HE X 4,192,103 3/1980 Sousek ..... 51/48 HE X

*Primary Examiner*—Gary L. Smith

*Attorney, Agent, or Firm*—Robert M. Krone; Joseph J. Kelly

[57] ABSTRACT

Apparatus for grinding a helical cutting surface on a flat cutting blade. Prior art grinders are complex, difficult to operate and expensive to use. The present grinding machine comprises a stationary support (74), a grinding arbor (76), an adjustable cam plate (78), a grinder carriage assembly (80), a grinder assembly (82), cam follower (112), mounted on the grinder carriage assembly (80), and a grinding stone (128) mounted on the grinder carriage assembly (80). When the carriage and the grinding stone are reciprocated along the axis of rotation of the grinding arbor the cam follower (112) contacts the lower surface of the cam plate (78) whereby the grinding arbor is oscillated about its axis of rotation and a helical cutting surface is ground into the blade (34).

22 Claims, 24 Drawing Figures

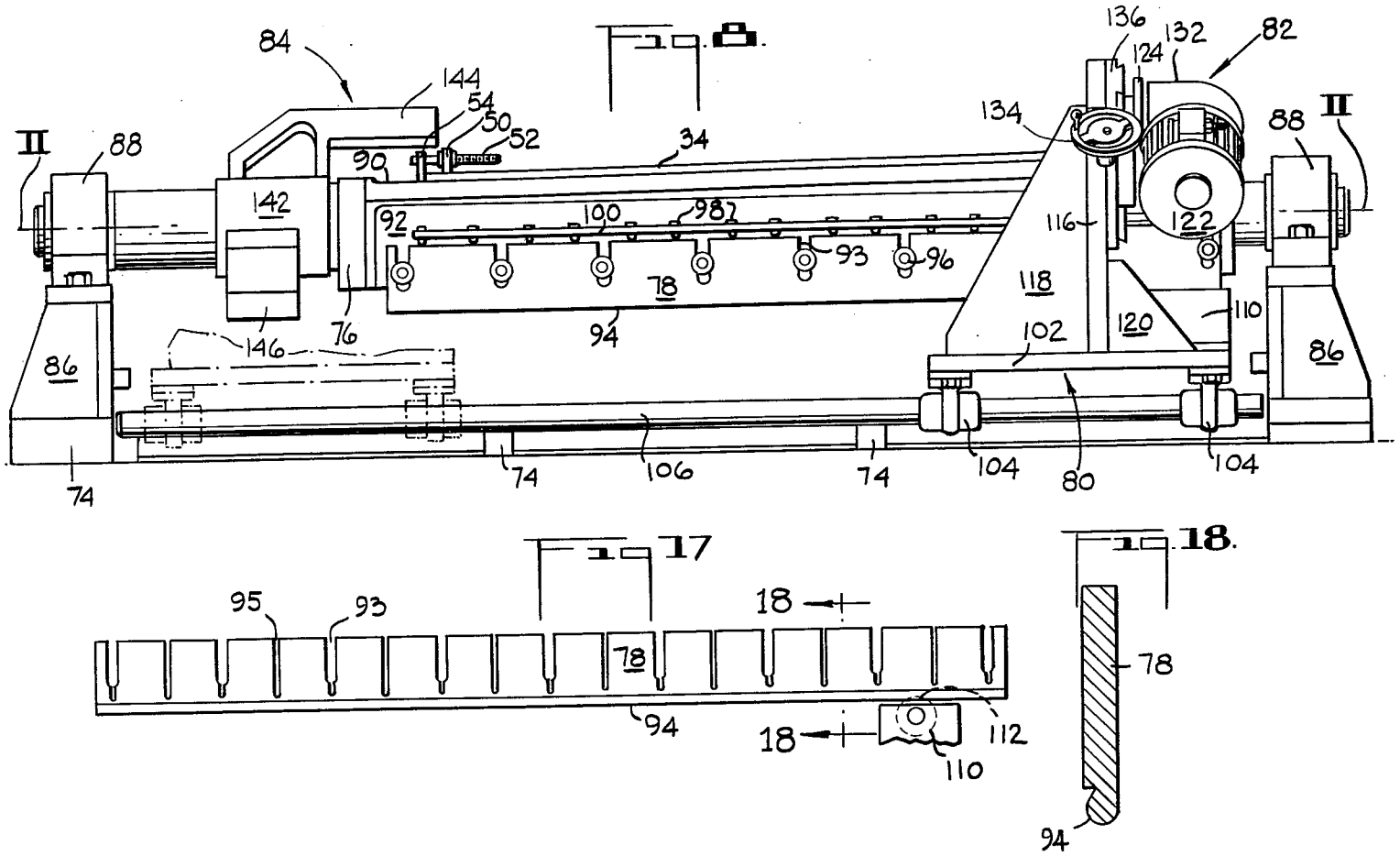
II
88
82
132
124
136
134
122
110
120
116
118
102
104
80
86
96
93
98
34
78
100
94
106
74
52
50
54
144
92
90
76
84
142
146
18
17
112
95

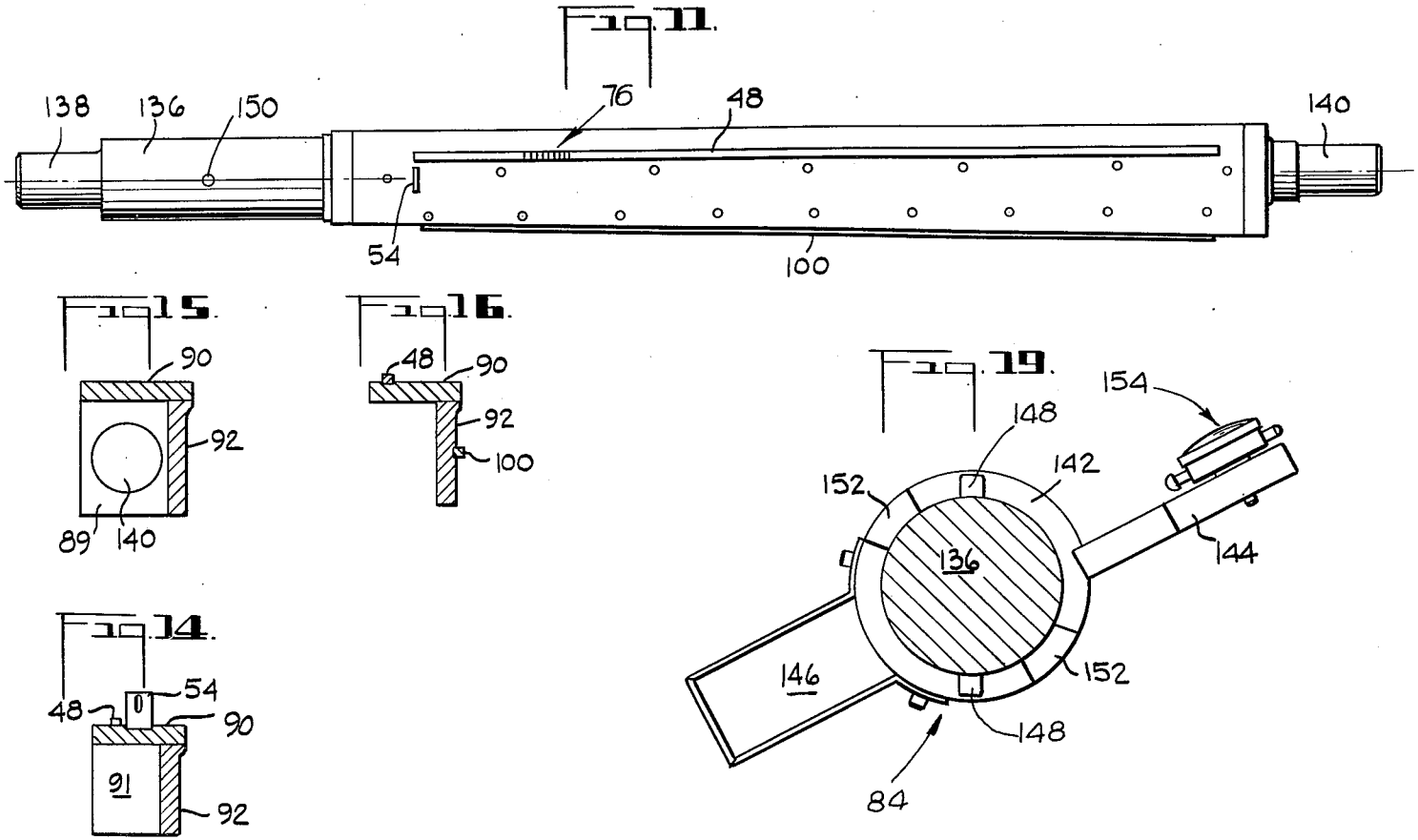
11
140
48
76
100
54
150
136
138
19
154
144
142
148
152
136
146
84
16
90
92
100
48
15
90
92
140
89
14
54
90
92
91
48

APPARATUS AND METHOD FOR GRINDING A HELICAL SURFACE ON A FLAT BLADE

TECHNICAL FIELD

This invention relates to grinding machines and more particularly to a machine for grinding a helical cutting surface on a flat cutting blade.

BACKGROUND OF PRIOR ART

Rotary cutters are used extensively. One example of a rotary cutter is illustrated in U.S. Pat. No. 2,870,839 issued Jan. 27, 1959 to Duane. In that patent, a fibrous blanket is conveyed through a device in which a plurality of continuous longitudinal cuts or slits are made in the blanket using a slitter. Downstream of the slitter, a plurality of moving cutter blades, constituted in the form of rotary saw blades, cut the blanket into a number of rectangular, fluffed chunks suitable for blowing insulation.

In continuing U.S. patent applications Ser. Nos. 33,355 and 84,694, filed Apr. 26, 1979 and Oct. 15, 1979 respectively, of U.S. patent application, Ser. No. 834,616, filed Sept. 19, 1977 which is now abandoned, a process for making a diced insulation product is disclosed. In the machine generally represented in that application, blowing wool may be made by delaminating fibrous blankets using a rotary cutter or dicer. The dicer is provided with a plurality of flat blades which have been manufactured with a ground helical surface. The flat blades, affixed to a dicer head formed in the shape of a truncated pyramid, cooperate with a stationary bed knife to cut the blankets. The bed knife is mounted with its cutting edge adjacent to the rotary shaft and is designed to cooperate with the flat blades in such a manner that when a compressed strip of blanket material is fed between the bed knife and the helical cutting surfaces of the rotating flat blades a progressive cutting action known in the art as a "draw" cut is made on the fibrous blankets.

Draw cuts are well known and may be based upon the principle of disposing one or more cutter blades on a rotary shaft angularly with respect to the axis of rotation of the shaft. A stationary bed knife, with its cutting edge parallel to the axis of the rotary shaft, is mounted on an anvil adjacent to the rotary shaft, and is designed to cooperate with the rotary cutter blade in such a manner that when a strip of material is fed between the two cutting edges, the rotating blade comes into cooperative action with the stationary cutting edge progressively, starting at one end of the cutting edge of the bed knife and progressively executing a cut on the material as the blade continues its rotary movement.

Well-known grinders for grinding cutter blades are complex, difficult to operate and therefore expensive to operate. Consequently, the blades ground with these grinders are expensive. Furthermore, these grinders do not facilitate the formation of a helical cutting surface on a flat blade which may be readily mounted on a rotary cutter. With these grinding machines, unnecessary labor and undue time is needed to ensure that the blades are properly mounted on the arbor of the rotary cutter relative to the bed knife.

BRIEF SUMMARY OF INVENTION

It is an object of the present invention to provide a relatively simple grinding machine suitable for forming a cutting surface on a flat blade.

Another object is to provide a grinder capable of forming a helical cutting surface on a straight flat blade.

A further object is the provision of a grinder which forms a helical cutting surface on a flat blade which is readily mounted on the blade arbor of a rotary cutter.

Still another object is the provision of a grinding apparatus which inexpensively grinds a helical cutting surface on a flat blade.

A still further object of the present invention is the provision of a method for providing a cutting blade with a cutting surface.

These and other objects are achieved in the present invention by an apparatus for grinding a cutting surface such as a helical cutting surface on a straight flat blade. A grinding arbor, rotatably mounted about an axis of rotation, is formed by two mutually perpendicular trapezoidal surfaces, joined at one of their nonparallel sides, and mounted obliquely to the axis of rotation of the grinding arbor. The flat blade to be ground is oriented at a compound angle with respect to the arbor axis of rotation by being mounted on one of the trapezoidal surfaces in such a fashion that its longitudinal axis is skew to the axis of rotation. A cam plate is mounted on the other trapezoidal surface as to ensure that its lower surface is equidistant from the arbor axis of rotation. The lower surface is abuttingly biased by the weight of the grinding arbor against a rotatable cam follower. A carriage provides a reciprocable foundation for the cam follower and a grinding stone and causes the cam follower and grinding stone to move in planes which are parallel to the arbor axis.

When it is desired to grind or resharpen a flat blade, the grinding stone surface is placed in contact with the blade. As the carriage is moved, the grinding arbor rotates about its axis because the lower surface of the cam plate is variably distant from the cam follower. At the end of its travel, the carriage may be moved in the opposite direction whereby the grinding arbor rotates in the opposite direction and a helical cutting surface is ground on the flat blade.

BRIEF DESCRIPTION OF DRAWINGS

FIG. 8 is a side view of the grinding apparatus of the present invention, with parts broken away for clarity.

FIG. 11 is a plan view of the grinding arbor used in the grinding machine of the present invention.

FIG. 17 is a plan view illustrating the cam plate and its interrelationship with the cam follower.

FIG. 18 is a sectional view taken along lines 18—18 of FIG. 17.

FIG. 19 is an enlarged view showing the dial indicator and dial indicator support.

DETAILED DESCRIPTION OF THE PREFERRED EMBODIMENT

Figure 1:
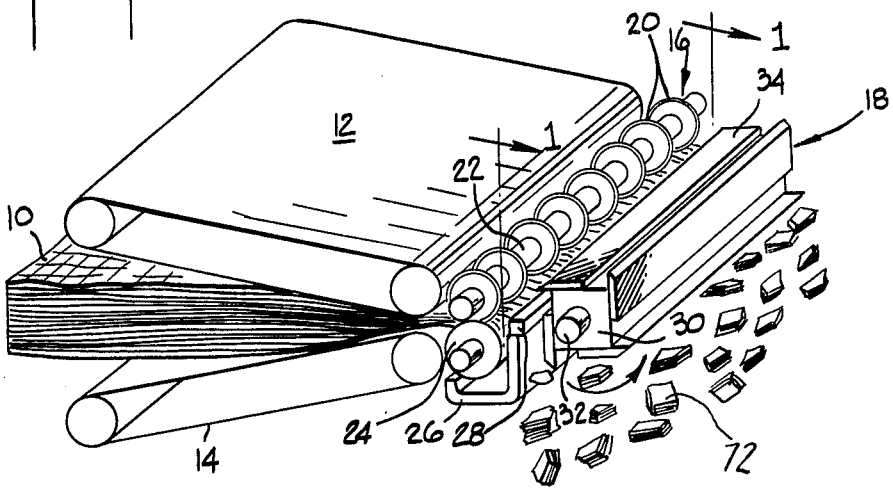
FIG. 1 is a simplified schematic view illustrating a use of a flat blade having a helical cutting surface ground with the apparatus of the present invention.

Referring now to the drawing wherein like reference numerals refer to like parts and more particularly to FIG. 1, a slitter-dicer machine is illustrated in which flat blades having a helical cutting surface are utilized. As shown in the figure, a fiber glass blanket 10 is continuously compressed and advanced by an upper compression conveyor 12 and a lower compression conveyor 14 towards a slitter assembly 16 and a dicer/cutter head assembly 18.

The slitter assembly 16 is composed of a plurality of rotatable slitter discs or blades 20 separated by a number of spacers 22 thereby forming a gang slitter. In abutting contact with the blades of the gang slitter is a rotatable opposition or anvil roll 24 made of an elastomeric material which is capable of withstanding repeated penetrations by the slitter blades 20 as they cut through the blanket 10. The gang slitter and the anvil roll 24 cooperate to form longitudinal cuts of equal width in the blanket 10 and contemporaneously cause the blanket to translate towards the dicer/cutter head assembly 18.

Figure 3:
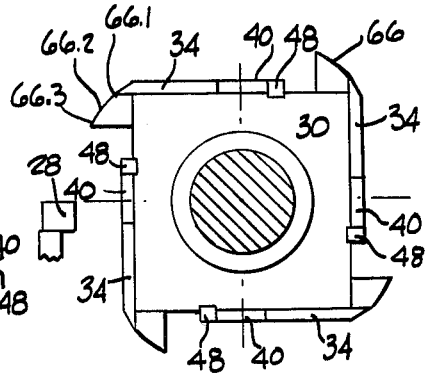
FIG. 3 is an end view taken along line 3—3 of FIG. 2.

The dicer head assembly 18 is comprised of a bed-knife support or anvil 26, bed-knife 28 and a dicer head or blade arbor 30. As can be seen from FIG. 2, the dicer head 30 is fixed to and rotates with a rotatable dicer head support shaft 32 (journaled in roller bearings, see FIG. 2) and is provided with a plurality of flat blades 34 capable of performing a draw cut; four in the present example. As can be seen from FIGS. 2 and 3, each of the blades 34 having a ground helical cutting surface are mounted on one of the four trapezoidal surfaces of a truncated pyramid forming the dicer head 30. Each of the four surfaces are oblique to the dicer head axis of rotation, I—I, represented by the support shaft 32 which is mounted parallel to the cutting edge of the bed knife 28.

Figure 1A:
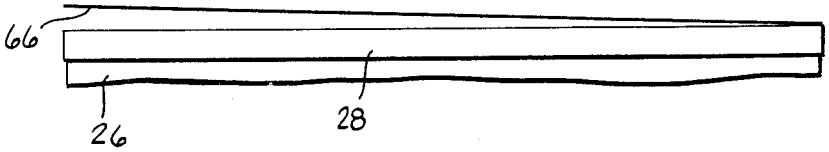
FIGS. 1*a*, 1*b* and 1*c* are taken along line 1—1 of FIG. 1 and show an approximation of a draw cut made by a blade ground by the present invention.
Figure 1B:
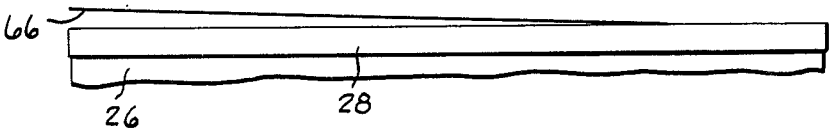
Figure 1C:
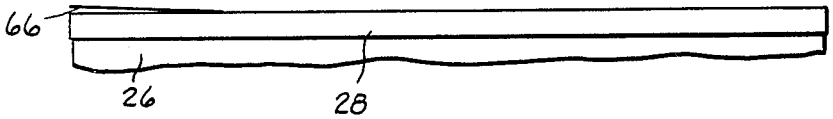

FIGS. 1*a*, 1*b* and 1*c* schematically illustrate a progressive or a draw cut which may be made by each of the blades 34 as the dicer head 30 is rotated abouts its axis I—I. In the interest of simplicity, only the bed knife 28, its support 26 and the cutting edge 66 of a blade 34 with a ground helical cutting surface is illustrated. As can be seen from the figures, as one of the rotating blades 34 approaches the bed knife 28, different points on its cutting edge 66 contact the bed knife at different times. At any one moment there is but one point-to-point shearing contact between the edge 66 and the bed knife 28. This point of shearing contact progressively moves along the bed knife from one end to the other. FIG. 1*a* shows the leading edge of the cutting edge 66 contacting the bed knife first, while FIG. 1*b* shows an intermediate portion of the cutting edge approaching the bed knife 28. FIG. 1*c* illustrates that a draw cut performed by a rotating blade 34 is being completed. It has been found that quicker and cleaner cuts of the fiber glass blanket 10 may be effectuated using a draw cut.

Figures 1, 2, 3, 6, 7, 12, 13, 14, 15, 16:
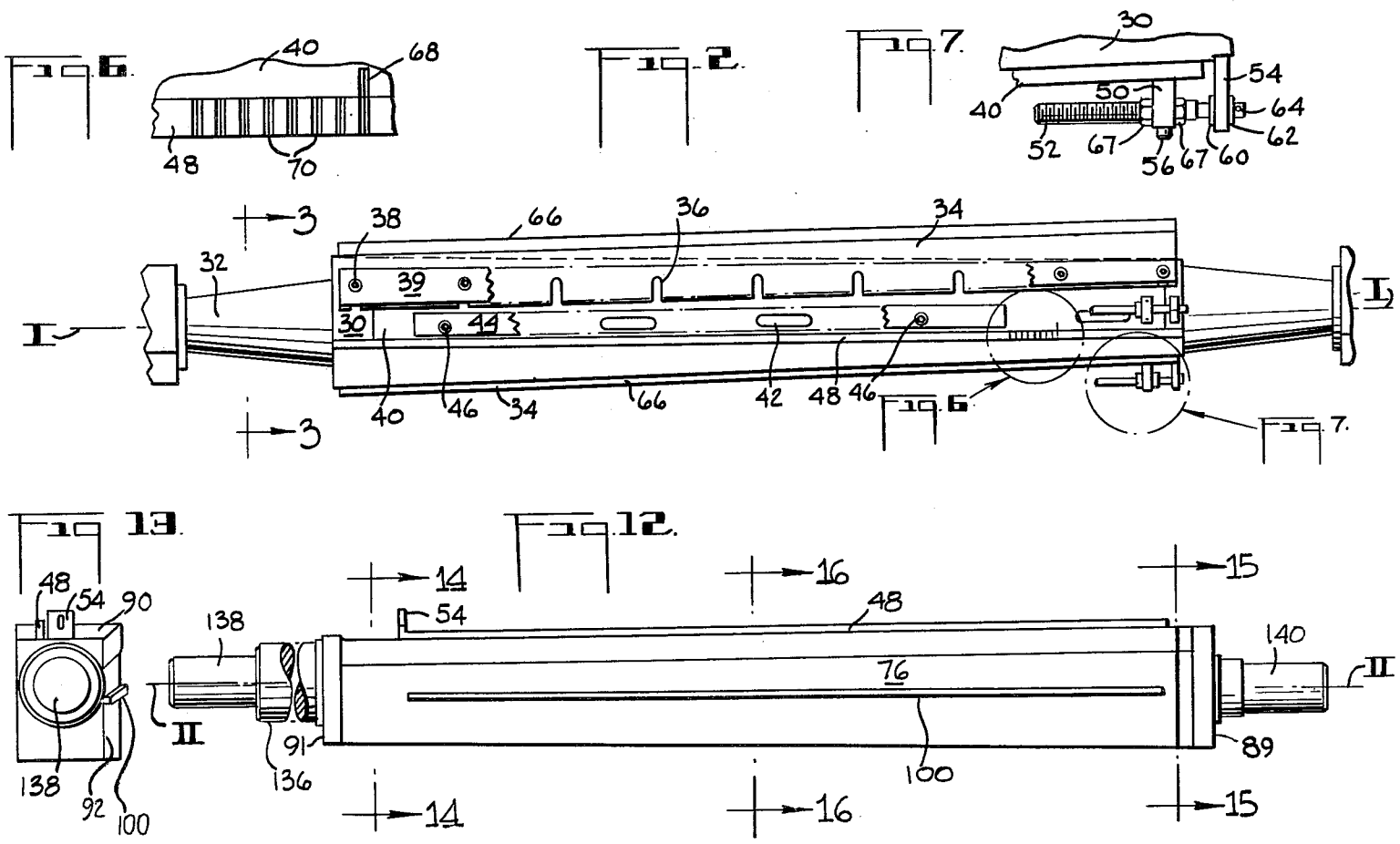
FIG. 2 is a plan view, partly broken away, of a dicer/cutter head assembly.
FIG. 6 is an enlarged view illustrating the indexing and alignment marks which facilitate mounting of the ground flat blades on the dicer head assembly.
FIG. 7 is an enlarged view of the gib block adjusting assembly.
FIG. 12 is a side view of the grinding arbor.
FIG. 13 is an end view of the grinding arbor.
FIG. 14 is a sectional view taken along lines 14—14 of FIG. 12.
FIG. 15 is a sectional view taken along lines 15—15 of FIG. 12.
FIG. 16 is a sectional view taken along lines 16—16 of FIG. 12.
Figures 4, 5, 20, 21:
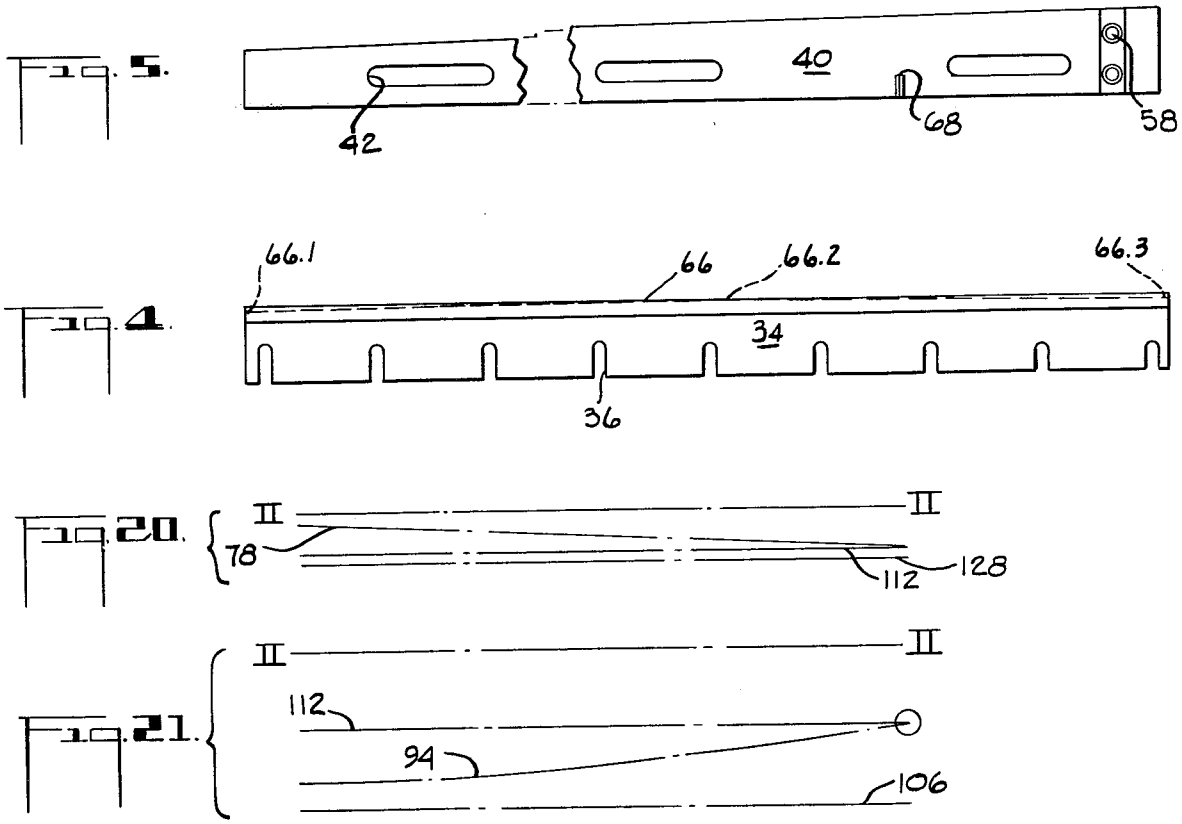
FIG. 4 is a plan view of a flat blade which may be formed with a helical cutting surface using the apparatus of the present invention.
FIG. 5 is a plan view of the tapered gib.
FIG. 20 is a simplified plan view of the grinder showing the centerlines of the grinding arbor, cam plate, grinding plane and cam follower plane.
FIG. 21 is a simplified side view of the grinder showing the centerlines of the grinding arbor, cam follower plane, the lower surface of the cam plate and shafts supporting the cam follower.

As FIGS. 2 and 4 indicate, each of the blades 34 are provided with a number of transverse slots 36 which allow each of the flat blades to be adjustably fixed on the dicer head 30 by means of some suitable fastening means such as bolts 38 and a blade clamping bar 39 which is juxtaposed between the bolts 38 and each blade 34. Backing up each blade 34 is a tapered gib 40 (see FIG. 5) which is provided with a plurality of longitudinal adjustment slots 42. The gib 40 is adjustably mountable on the dicer head 30 by means of a gib clamping bar 44 and bolts 46. The gib 40 is abuttingly supported by means of a gib support keyway 48 which fits in a slotted key formed in the dicer head 30. The key 48 and the surface of the gib 40 which abuts the support key 48 are parallel to the axis I—I, as may be seen from FIG. 2. The tapered gib allows a flat blade 34 to be mounted on the dicer head 30 at a compound angle relative to the axis I—I. In other words, the blade 34 is not only mounted on a surface which is oblique to the axis I—I, but is mounted on that surface with its longitudinal axis skew to the axis of rotation of the arbor 30.

FIG. 7 illustrates a tapered gib adjustment means comprising a gib block 50, adjusting screw 52 and an adjusting screw adapter block 54. The gib block is fixedly attached to one end of the tapered gib 40 by means of bolts 56 which pass through mounting holes 58 drilled in the gib. The gib block 50 cooperates by means of the adjusting screw 52 with the adjusting screw adapter block 54, which is attached to the dicer head 30, in order to move the tapered gib along the axis of rotation of the dicer head. The adjusting screw is provided at one end with a fixed washer 60 which contacts the block 54 when the screw 52 is inserted in a guide hole formed in the block 54. A flat washer 62 and a roll pin 64 prevent the end of the screw 52 from translating while allowing rotation of the screw.

The distance between the blocks 50 and 54 may be adjusted by rotating the screw 52. As the distance increases, the gib block 50 is moved longitudinally along the axis I—I. Correspondingly, since the gib 40 is tapered and in contact with a flat blade 34, the cutting edge 66 of the blade 34 is moved away from the dicer head axis of rotation. The position of the adjusting screw may be fixed by means of lock nuts 67 and the position of the blade 34 relative to the dicer head axis of rotation may be arbitrarily denoted by an indexing system illustrated in FIG. 6.

As seen in FIGS. 2 and 6, the gib 40 is provided with a single index mark 68 and the gib support key is impressed with a plurality of regularly spaced marks 70. These marks 68, 70 have an important role to play in placing the blades 34 on the dicer head or blade arbor after the blades have been ground with a helical cutting surface using the grinder of the present invention. This role will be more fully discussed, infra.

In order for the cutting edge 66 of each of the rotating flat blades to clear the cutting edge of the bed knife and in order to obtain a "draw" cut, as defined above, so that the blanket 10 may be sheared into a multitude of diced pieces of insulation 72 which are capable of delaminating, a helical cutting surface must be imposed on each of the blades 34. FIG. 4 shows in phantom a helical cutting surface ground on the cutting edge 66 of each of the blades 34 using the grinder of the present invention while the solid lines represent a flat blade as received from the manufacturer. The numerals 66.1, 66.2 and 66.3 represent the trailing, intermediate and leading portions of the blade, respectively. It must be remembered at all times that each of the blades are mounted on one surface of the four-sided, truncated pyramid which forms the structure of the dicer head 30 and that each point along each cutting surface 66 must be equidistant from the axis of rotation of the dicer head which has been mounted parallel to the bed knife 28. This means that each blade is mounted about the axis I—I such that its major dimension is at an angle or oblique to the dicer head axis of rotation. Consequently, in order to guarantee that each cutting edge 66 clears the bed knife 28 and to guarantee the desired shear or draw cut, a helical cutting surface must be formed on each edge 66. This is accomplished in the present invention through the use of the following grinding machine.

The instant grinding apparatus has a rotatable arbor formed by perpendicularly joining two trapezoidal plates along one of their skew sides. A cutting blade is fixedly mounted about the longitudinally extending axis of the arbor on one of the plates while a cam surface having an arcuate contour is mounted on the other plate so that it lies in a plane extending obliquely to the longitudinal axis. The weight of the arbor causes the cam surface to be urged onto a cam follower which is mounted on a carriage. The carriage supports a blade cutter or grinder in order to ensure that the blade cutter and the cam follower travel in planes parallel to the longitudinal axis of the arbor and the arbor rotates as the carriage is moved. This arrangement brings the blade and the blade cutter into a proper relationship so that the blade is provided with a cutting surface such as a helical cutting surface.

Figure 10:
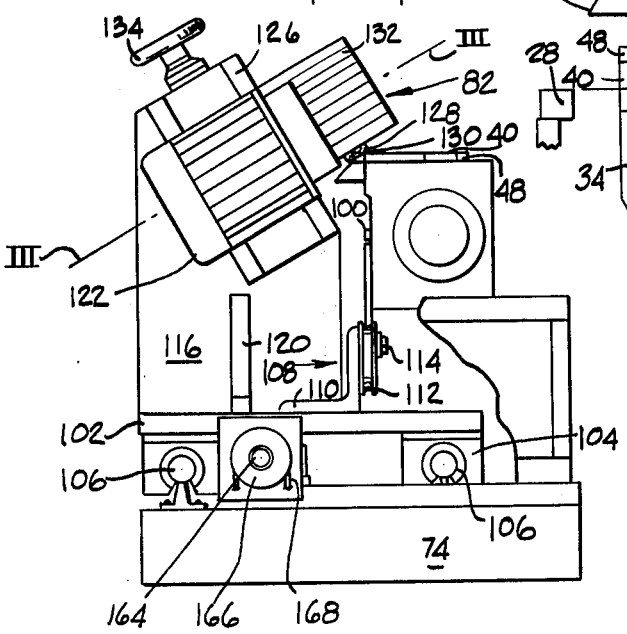
FIG. 10 is an end view of the present grinding machine, with parts broken away.
Figure 9:
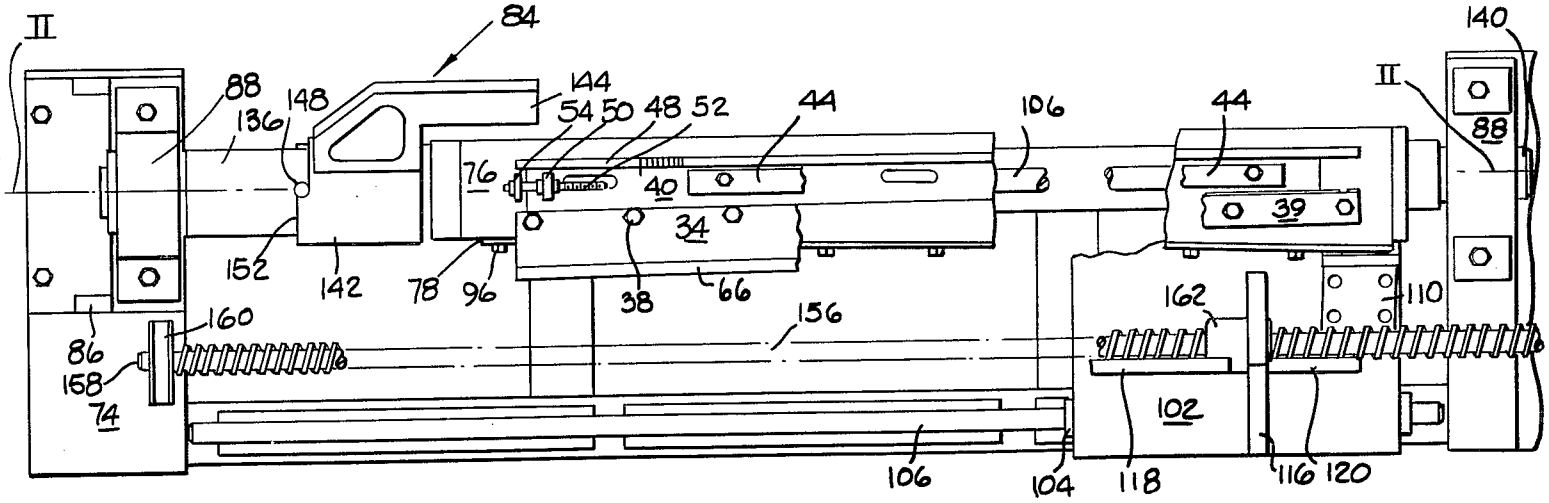
FIG. 9 is a plan view of the grinding apparatus of the present invention, with parts broken away.

A preferred embodiment of the grinding apparatus of the present invention, illustrated in FIGS. 8, 9 and 10, comprises a stationary support or frame 74, a grinding arbor 76, cam plate 78, grinder carriage assembly 80, grinder assembly 82 and a dial indicator assembly 84. Two bearing mounts 86 are fitted upon the frame 74 and support two pillow block roller bearings 88. These bearings provide rotational support for the ends of the grinding arbor 76.

The grinding arbor 76 is the functional couterpart of the blade arbor or dicer head 30 and is constructed with two mutually perpendicular surfaces 90, 92 which mate with plates 89, 91. Surfaces 90, 92 are trapezoidal in shape and form one half of the four-sided truncated pyramid structure of the dicer head. Each surface 90, 92 is mounted obliquely to the axis of rotation II—II of the grinding arbor.

Surface 90 provides a mounting surface for a flat blade 34 which is to either be given a cutting surface such as a helical cutting surface or is to be resharpened. As with the dicer head 30, a tapered gib 40 is juxtaposed between the blade 34 and a gib backup or support key 48. Similarly, the support key 48 is mounted parallel to the axis II—II. The tapered gib 40 ensures that the longitudinal axis of the blade 34, which is mounted on surface 90 that is oblique to axis II—II, is oriented skew to the axis II—II. This orientation of the blade helps to guarantee that a helical cutting surface will be imposed along the entire cutting edge 66. Both the flat blade 34 and the tapered gib 40 are adjustably clamped in place utilizing their respective clamping bars 39 and 44 and bolts 38 and 46. Also present is a tapered gib adjustment means represented, in part, by gib block 50, adjusting screw 52 and adjusting screw adapter block 54.

The cam plate 78 is mounted on the surface 92 and is provided with a number of attachment slots 93 and a plurality of deflection slots 95 which allow the lower surface or cam surface 94 of cam plate 78 to be deflected along its length (see FIGS. 8 and 17; plate 78 has been simplified in FIG. 8 for purposes of clarity). After the cam plate is adjustably fixed to the surface 92 by means of a plurality of hex head screws and washers 96, the cam surface 94 may be deflected by means of a plurality of socket set screws 98 mounted on a cam set-up bar 100 which is inserted within surface 92. The cam surface 94 is deflected in order to ensure that every point along its length is equidistant from the axis of rotation II—II of the grinding arbor and once adjusted may be fixed using any suitable means. Thus, the cam surface 94 represents one aspect of a helical cutting surface which may be ground on the flat blade 34.

The grinder carriage assembly 80 comprises a grinder carriage 102 slidably mounted for translation by means of pillow blocks 104 on two parallel bearing shafts 106, suitably mounted on the frame 74, and a cam follower assembly 108. The upper surface of the carriage 102 and the shafts 106 are parallel to the axis II—II and may be suitably adjustable to ensure this parallelism. The cam follower assembly 108 comprises a roller bracket 110, mounted on the carriage assembly 102, a guide or cam follower wheel 112 and an eccentric cam 114. The cam follower wheel 112 is suitably rotatably attached to the bracket 110 by means of the eccentric cam 114 which allows the cam follower wheel 112 to be adjustably and fixedly placed in abutting contact with the cam surface 94 (see FIG. 10). During the grinding operation the wheel 112 moves in a plane which is parallel to the axis II—II.

Also mounted on the grinder carriage assembly 80 is the grinder assembly 82 which is composed of a support structure that comprises a vertical support plate 116 and gussets 118, 120. The plate 116 also supports a grinding motor 122 via a motor mounting plate 124 and a grinder adjustment slide or rail 126. The motor 122 drives a grinding wheel or stone 128 which is provided with an appropriate dresser (not shown) which ensures a flat grinding surface 130. The grinding stone which rotates about an axis III—III, illustrated in FIG. 10, is shielded using a protective cover 132 providing some protection for the operator of the grinding machine from rapidly moving particles formed by the grinder during use. The grinder adjustment slide 126 is provided with a grinding stone vertical adjustment wheel 134 which is capable of adjustably controlling the position of the grinding surface 130 relative to the cutting surface 66 of the flat blade 34. As with the cam follower 112, during the grinding operation, the grinding wheel 128 moves with the carriage 102 in a plane which is parallel to the axis II—II.

Turning for the moment to FIGS. 20 and 21, it can be readily seen that the cam plate 78 is mounted obliquely to the grinding arbor axis II—II while the planes defined by the grinding stone 128 and the cam follower are parallel to the axis II—II (see FIG. 20 which illustrates a simple plan view of the centerlines of the respective planes defined above). FIG. 21, generally indicates a side view of the planes passing through the axis II—II and the shafts 106 which provide a support for the follower 112. The cam follower is slidingly fixed on the shafts 106 such that when moved by the carriage, it defines a plane which is parallel to the axis II—II. The line designated by the numeral 94 represents, in exaggerated form, the shape of the cam plate lower surface 94 after it has been adjusted to ensure that every point along its length is equidistant from the axis II—II. The figure clearly indicates an arcuate shape for the surface 94 that is variably distant from the shafts 106 and thus the carriage 102 and the cam follower 112.

Rotatably mounted on a portion 136 of the grinding arbor 76 proximate one of its end shafts 138, 140 is the dial indicator assembly 84. As FIGS. 8, 9 and 19 indicate, assembly 84 comprises a dial indicator support 142 which is rotatably mounted on the portion 136. Support 142 is mounted such that its axis of rotation coincides with the axis of rotation of the grinding arbor. As FIG. 19 shows, support 142 is provided at one end with an adjustable dial indicator mount 144 and at its other end with a counterweight 146. Rotation of the dial indicator support 142 is limited by means of dowel stop pins 148 which fit in a hole 150 in the portion 136 so that when pins 148 contact protrusions 152, the necessary operations utilizing the dial indicator 154 may be carried out without uncontrolled rotation of the support 142.

Before grinding any blade, the operator of the grinding machine of the present invention ensures that both of the bearing shafts 106 are mutually parallel and that their centerlines define a shaft plane which is parallel to axis II—II. Through previous adjustments, the cam surface 94 has been adjusted by means of the socket set screws 98 such that every point along its length is equidistant from the axis II—II. A flat blade 34, to be either ground or resharpened, is mounted on the surface 90 of the grinding arbor such that its longitudinal axis is skew to the axis II—II and is moved outwardly from the axis by means of the tapered gib adjustment means. By rotating the adjusting screw 52, the entire cutting edge 66 is moved outwardly a distance which is somewhat greater than the distance the cutting edge will be when it is mounted on the dicer head 30. When a cutting surface such as a helical cutting surface is finally ground on the cutting edge 66, each point on the edge will be equidistant from the axis II—II, will be able to clear the cutting edge of the bed knife 28 and will perform the desired draw cut referred to above.

As a further condition precedent to beginning the grinding operation, the position of the dial indicator 154 relative to the axis II—II must be preset such that when the dial indicator support 142 is rotated and the plunger of the dial indicator contacts the cutting edge 66, readings on the blade dimension may be taken. If properly preset, the dial indicator will read "zero" when the prerequisite helical cutting surface has been formed on the edge 66.

To begin the grinding operation, an operator of the present invention starts the grinding motor 122 and places the grinding stone 128 in contact with the blade, as shown in FIGS. 8 and 10 by means of the grinder adjustment slide 126 and the grinder stone vertical adjustment wheel 134. Using a handle, not shown, the operator translates the grinder carriage assembly 80 from the right of FIG. 8 to the left of FIG. 8, as shown in phantom, and back again. The cam follower wheel 112 is in contact with the cam surface 94 because of the weight of the grinding arbor 76. Since the cam surface 94 is equidistant from the axis II—II and thus at a variable distance from the follower 112 and since the cam plate 78 is mounted at an oblique angle relative to axis II—II, the grinding motor 76 pivots or oscillates generally clockwise and counterclockwise as the assembly 80 is translated by the operator from the right to the left and vice versa. The grinding surface 130 reciprocates with the assembly 80 back and forth across the cutting edge 66 and moves in a constant plane that is parallel to the axis II—II. By this process, the grinding stone 128 cuts or grinds a helical cutting surface on the flat blade 34.

As was explained earlier, the tapered gib 40 has an index mark 68 and the gib support key has a plurality of regularly spaced marks 70. Thus, as the blade 34 is moved by means of the tapered gib adjustment assembly, the index 68 may be lined up with a mark 70. Using this system, the operator of the slitter-dicer apparatus may know, by means of the marks 68, 70, how far the cutting edge 66 was extended from the axis II—II when the blade 34 was given either a new helical cutting edge or was resharpened. Since the grinding arbor 76 and its axis II—II are the structural and functional counterparts to the blade arbor 30 and its axis I—I, an operator may mount a ground blade 34 at the same distance from the axis I—I that the operator of the arbor 76 mounted the blade 34 from the axis II—II. This information may be transmitted from the operator of the grinder to the operator of the dicer head by suitably marking the ground blade 34. In resharpening blades which have been greatly worn, shims may be used between the tapered gib 40 and the gib support key 48 in order to allow the blade 34 to be given an extended service life. This allows the blade to be sufficiently extended from either the axes I—I or the axis II—II. The information as to the presence or absence of shims would also be exchanged between the operators by means of appropriate blade marking.

As an option to manually reciprocating the grinder carriage, a suitable drive may be provided. One such arrangement is shown in FIGS. 9 and 10 wherein a carriage drive subassembly is partially illustrated. As seen in FIG. 9, a conventional lead screw 156 is fixed at one end 158 by means of a bearing 160 which is fixed to the frame 74. An intermediate portion of the lead screw 156 threadingly engages a travelling nut 162 affixed to the vertical support plate 116. A pulley 166, which is connected by means of a belt 168 to a suitable drive (not shown) is affixed at the other rotatably supported end 164 of the screw. An alternative to the screw 156, which is threaded in both directions to cause the back and forth translation of assembly 80, is a conventional switching mechanism (not shown) which may be electrically connected to the drive in order to reverse the direction of the motor.

It will be evident that the flat blades ground using the present apparatus are suitable for any situation requiring a flat blade having a helical cutting surface and are not restricted to their use in a slitter-dicer apparatus of the type described above.

It will also be understood that various changes may be made in the specific embodiment described, supra, without departing from the spirit thereof, or from the scope of the appended claims.

What is claimed is:

1. Apparatus for grinding a helical cutting surface on a flat cutting blade, comprising:

a stationary support, an arbor for mounting said blade, said arbor being rotatably mounted on said support about an axis of rotation, said arbor having at least two mutually perpendicular planar surfaces which are disposed oblique to said axis of rotation;

means for mounting said blade on one of said planar surfaces, an adjustable cam plate mounted on the other of said planar surfaces, means for adjusting all points along the lower surface of said cam plate such that said lower surface is equidistant from said axis of rotation, a carriage mounted on said support for reciprocation along a plane parallel to said axis of rotation, a cam follower for contacting said lower surface, means for mounting said cam follower on said carriage, means for grinding said blade, and means for mounting said grinding means on said carriage such that said grinding means may be reciprocated along a plane parallel to said axis of rotation, whereby when said carriage and said grinding means are reciprocated, said cam follower contacts the lower surface of said cam plate, said arbor is oscillated about its axis of rotation and a helical cutting surface is ground into said blade.

2. Apparatus of claim 1, further comprising means for adjusting the position of the cutting edge of said blade relative to said axis of rotation.

3. The apparatus of claim 2, wherein said blade adjusting means comprises a tapered member adjustably mounted on said arbor, a back-up member abuttingly contacting said tapered member and fixedly mounted on said arbor, said tapered member being juxtaposed between said blade and said back-up member and means for adjusting the position of said tapered member along said axis of rotation.

4. Apparatus of claim 3, wherein said tapered member adjusting means comprises an adjusting screw rotatably mounted in a block fixed on said arbor and a block fixed on said tapered member, said arbor block rotatably fixing one end of said adjusting screw whereby when said adjusting screw is rotated and the distance between said arbor block and said tapered member block is increased, said tapered member is translated along said axis of rotation and the distance between the cutting edge of said blade and said axis is increased.

5. Apparatus of claim 4, further comprising an index mark on said tapered member and a plurality of regularly spaced index marks on said back-up member located proximate said tapered member index mark whereby when said tapered member adjusting means is adjusted, the position of said blade is adjusted relative to said axis of rotation and said index marks may be aligned.

6. Apparatus of claim 5, wherein said cam plate adjusting means comprises a cam set-up bar mounted on said other planar surface and, a plurality of set screws, said set screws being mounted on said set-up bar and acting on an upper portion of said cam plate in order to deflect said lower surface.

7. Apparatus of claim 6, wherein said cam plate is provided with a plurality of slots which allow all points along said lower surface to be adjusted equidistant from said axis.

8. Apparatus of claim 6, wherein said blade is provided with a plurality of transverse slots, and a plurality of arbor-mounted bolts passing through said blade transverse slots whereby said blade is capable of linear translation relative to said axis by means of said blade transverse slots and said arbor-mounted bolts.

9. Apparatus of claim 8, wherein said blade mounting means comprises a clamping bar and said arbor-mounted bolts, said arbor-mounted bolts abuttingly contacting said blade clamping bar.

10. Apparatus of claim 6, wherein said carriage is mounted on a plurality of mutually parallel bearing shafts, said bearing shafts defining a plane which is parallel to said axis of rotation.

11. Apparatus of claim 10, wherein said cam follower mounting means comprises a bracket attached to said carriage, said cam follower being rotatably mounted to said follower bracket by means of an eccentric cam whereby said follower may be vertically adjusted in order to contact said lower surface.

12. Apparatus of claim 10, wherein said grinding means is a grinding stone, said grinding stone having a grinding surface defining a plane, said grinding surface plane being parallel to said axis of rotation.

13. Apparatus of claim 10, wherein the mounting means for said grinding means comprises a vertical support fixed to said carriage and means attached to said vertical support for adjusting the vertical position of said grinding means.

14. Apparatus of claim 13, wherein said grinding means vertical adjustment means comprises a slide mounted to said vertical support and to said grinding means, and an adjusting wheel for adjusting the position of said grinding means on said slide.

15. Apparatus of claim 12, further comprising means for translating said carriage.

16. Apparatus of claim 15, wherein said carriage translation means comprises a handle.

17. Apparatus of claim 15, wherein said carriage translation means comprises a lead screw, said lead screw being rotatably fixed at one end on said stationary support, the other end of said carriage translation means being supported rotatably and affixed to a rotation inducing means.

18. Method for providing a cutting surface on a cutting blade, comprising:

mounting a cutting blade on a first plane for rotation about a longitudinally extending axis, mounting a cam surface on a second plane which is perpendicular to said axis, disposing said first and second planes at an oblique angle relative to said axis, adjusting said cam surface, providing a cam follower, urging said cam surface into contact with said cam follower, providing blade cutting means, and moving said cam follower and said cutting means to rotate said blade and to bring said blade and said cutting means into a proper relationship whereby said blade may be provided with a cutting surface.

19. Method as in claim 18, further comprising moving said cam follower and said cutting means simultaneously.

20. Method as in claim 18, comprising adjusting all points along the lower surface of said cam surface to be equidistant from said axis.

21. Method as in claim 20, further comprising moving said cam follower and said cutting means in a longitudinal direction parallel to said axis.

22. Apparatus for providing a cutting surface on a cutting blade, comprising:

means for mounting a blade, said mounting means being mounted for rotation about a longitudinally extending axis, said mounting means being provided with at least two mutually perpendicular surfaces which are inclined with respect to said axis;

said blade being mounted on one of said surfaces, a cam surface, said cam surface being mounted on the other of said surfaces, means for adjusting all points along the lower contour of said cam surface, a cam follower, means for urging said cam surface into contact with said cam follower, a blade cutting means, and means for moving said cam follower and said cutting means to rotate said mounting means and to bring said blade and said cutting means into a proper relationship thereby providing said blade with a cutting surface.

* * * * *